United States Patent [19]

Josephs

[11] Patent Number: 4,713,578

[45] Date of Patent: Dec. 15, 1987

[54] GETTER ASSEMBLY WITH DIFFUSION DIRECTING STRUCTURE

[75] Inventor: Mark A. Josephs, Seneca Falls, N.Y.

[73] Assignee: North American Philips Consumer Electronics Corp., New York, N.Y.

[21] Appl. No.: 449,897

[22] Filed: Dec. 15, 1982

[51] Int. Cl.[4] ..... H01J 29/94; F04B 37/02

[52] U.S. Cl. ..... 313/481; 313/558; 313/560; 417/48

[58] Field of Search ..... 313/481, 545, 546, 553, 313/558, 559, 560, 561; 417/48, 51

[56] References Cited

U.S. PATENT DOCUMENTS

| | | | |
|---|---|---|---|
| 3,816,788 | 6/1974 | Reash | 313/481 |
| 3,996,488 | 12/1976 | Zucchinelli | 313/481 X |
| 4,134,041 | 1/1979 | della Porta et al. | 313/560 X |
| 4,323,818 | 4/1982 | Madden et al. | 313/481 |

*Primary Examiner*—David K. Moore
*Assistant Examiner*—K. Wieder
*Attorney, Agent, or Firm*—John C. Fox

[57] ABSTRACT

An improved getter assembly for use in cathode ray tubes, and particularly in cathode ray tubes that require a clear area or window, the getter assembly including a container with getter diffusion directing tabs extending from the sidewall of the container in a direction away from the window area.

5 Claims, 4 Drawing Figures

GETTER ASSEMBLY WITH DIFFUSION DIRECTING STRUCTURE

BACKGROUND OF THE INVENTION

This invention relates to a getter assembly for use in controlling directionality of getter flash within cathode ray tubes and more particularly to a getter assembly which minimizes deposition of the getter material at undesirable locations within the cathode ray tube, such as a clear or window area.

Cathode ray tubes (CRTs) are dependent for their successful operation upon the absence of reactive gases, loose particles or other foreign material within the tube envelope. While the tube's atmosphere is evacuated prior to sealing of the tube, various residual materials, in the form of, for example, adsorbed gases or low vapor pressure solids, are released into the envelope during subsequent tube operation. In order to prevent such materials from interfering with successful tube operation, it has long been a common practice in the CRT art to deposit a "getter" material onto the interior surface of the tube envelope after it has been sealed. The function of such getter, usually barium, is to absorb the potentially harmful gases released during tube operation, and prolong the tube's useful life.

The most common means of depositing such getter material is to "flash" or evaporate it from a container located near the tube funnel interior wall by R.F. heating. Such container must be strategically shaped and placed to avoid excessive deposition in or near the neck region of the tube, since such deposition could result in stray emissions, arcing, and other operating defects, due to the low potential of the neck region of the tube compared with the higher potential region forward of the neck region. Similarly, since the getter container itself is conductive and usually supported by a conductive "wand" extending from the electron gun, excessive getter flash in the immediate vicinity of this so-called "getter assembly" must also be avoided in the interest of minimizing arcing. Finally, excessive deposition on the screen itself is obviously undesirable in that it results in reduced overall light output. However, this situation is generally uncommon in today's tube designs in which the screen is not only substantially protected from getter flash by the intervening shadow mask but also by various internal shielding means designed to shield the screen from stray electrons, and the tube itself from deleterious magnetic fields.

Various techniques have been proposed for controlling the amount and distribution of the getter flash in CRTs, with varying degrees of success. See, for example, U.S. Pat. Nos. 3,816,788 and 4,323,818.

Some recently proposed cathode ray tube applications require a clear area or window on one side of the tube funnel, and also require that the shadow mask be relatively free of getter material. No known getter assembly is capable of satisfying the above requirements while still avoiding the deposition of excessive material in the neck and getter assembly regions, needed to avoid excessive arcing.

Accordingly, it is an object of this invention to provide a getter assembly that will avoid the deposition of gettering material: (a) in a clear area or window on one side of a tube funnel; (b) in the mask area; and (c) in the neck area, yet still provide sufficient gettering material to result in useful tube operating life.

SUMMARY OF THE INVENTION

The invention provides an improved getter assembly for use in cathode ray tubes, but more particularly in cathode ray tubes that require at least one clear area or window area on one side of the tube funnel, and also require that this window area as well as the shadow mask be relatively free of getter material.

In accordance with one aspect of the invention, the getter assembly includes a generally cylindrically shaped receptacle containing a side opening framed by two tabs extending outward that serve as diffusion directors. An overlapping disc-shaped cover is affixed to the top of the receptacle and also acts as an effusion director.

The getter receptacle is attached to a metal spring member or wand which is in turn connected to the electron gun assembly. The resultant getter assembly is discretely oriented inside the cathode ray tube so that when it is "flashed", the effusion of gettering material is directed substantially to one side of the tube funnel, resulting in a minimal deposition of gettering material in the mask area, in the neck area and in a clear window or area on the other side of the tube funnel.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
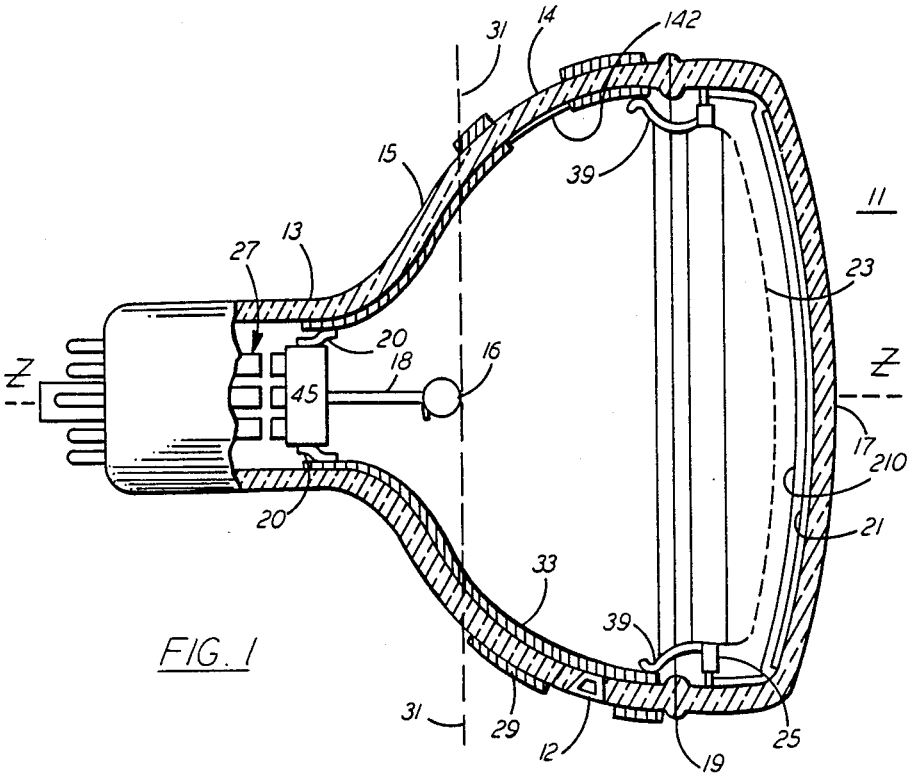
FIG. 1 is a cross-sectional view of a cathode ray tube wherein the invention is utilized.

With reference to FIG. 1, a plural beam color cathode ray tube construction 11 is illustrated as having an envelope comprised of an integration of neck 13, funnel 15 and face panel 17 portions; the panel and funnel portions being hermetically integrated during tube fabrication along the congruent sealing region 19. A patterned cathodoluminescent screen 21, of color-emitting phosphor areas, is disposed on the interior surface of the viewing panel 17 as an array of definitive stripes or dots, in keeping with the state of the art. A multi-apertured structure, in the instance, a shadow mask 23, having openings discretely shaped in keeping with the pattern of the screen, is oriented within the viewing panel by a plurality of locator means 25, in spatial relationship to the patterned screen.

An exemplary and partially deetailed plural beam electron gun assembly 27 is positioned within the neck portion 13 of the envelope in a manner to project a plurality of electron beams to converge in the region of the shadow mask 23 and thence impinge upon the patterned screen 21.

It has been conventional practice to dispose electrical conductive coatings on both the interior and exterior surfaces of the funnel portion. These coatings in conjunction with the intervening glass of the funnel 15 form a capacitance filtering effect which is utilized in the operational circuitry of the associated television or image display device. The exterior coating 29 on the funnel member is of an electrically conductive material such as a suspension of graphite particles in a coating vehicle, and is disposed on a portion of the external surface extending from substantially the region adjacent the panel funnel seal 19 to a plane 31 substantially rearward of the mid-region of the funnel. An area around the electrical transversal or anode button 12, and as relates to this invention, a clear or window area 14, are kept free of such coating. The interiorly applied coating 33 is normally formed of a similar coating material, but also containing particles of an oxide such as iron oxide. Such interior coating 33 has the electrical potential for the screen and the terminal electrode member of the electron gun assembly applied thereby by the funnel-disposed anode button 12. The coating 33 extends from substantially the region adjacent the panel-funnel seal 19 into the neck portion of the envelope to effect an electrical connection between the mask 23 via spring connectors 39 and the terminal electrode 45 of the electron gun assembly 27, via spring connectors 20. A high voltage is conventionally applied to the inner coating through the anode button 12.

A getter wand 16 is mounted on an elongated metal spring member or wand 18 in a manner such that diffusion directors 22 and 24 extend in a direction approximately normal to the length of the wand 18. Wand 18 is attached to the top cup or convergence cup 45 of electron gun assembly 27.

Figure 2:
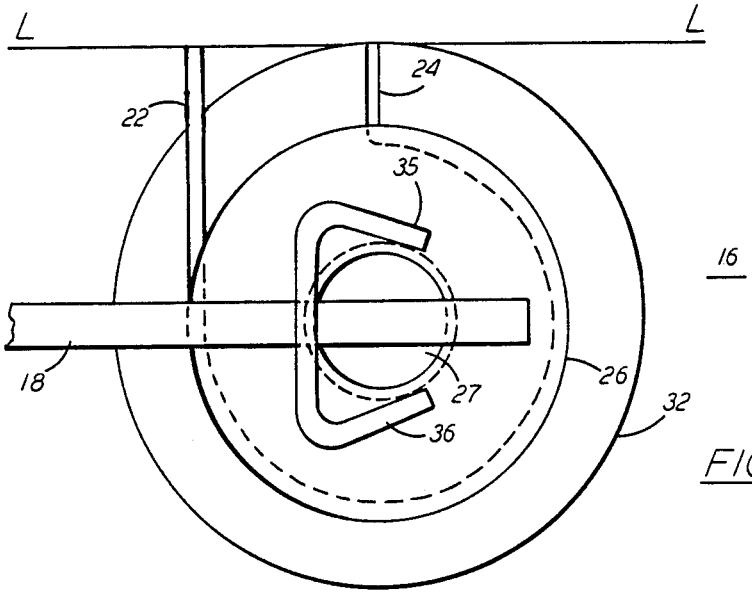
FIG. 2 is a plan view of the underside of the getter of the present invention.
Figure 3:
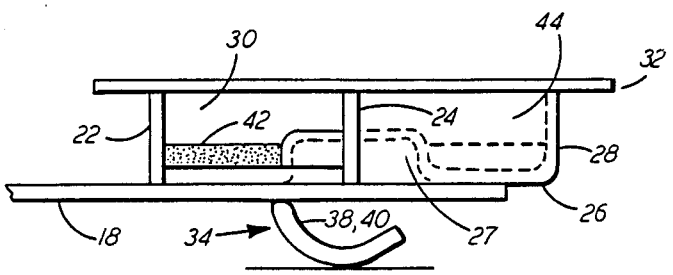
FIG. 3 is an elevation view of the getter of the present invention.

Referring to FIGS. 2 and 3 in greater detail, the getter wand 16 comprises a cylindrical getter cup 26 having an attached cover disc 32 and a wire support member 34. In this embodiment, the getter cup 26 contains an upraised bottom portion 27, a sidewall 28 about 2 times greater in height than the height of upraised bottom portion 27, and an opening 30 created by cutting sidewall 28 and bending two diffusion directors (tabs) 22 and 24 outward in opposite directions. Diffusion director 24 is located approximately on the centerline of cup 26 and extends approximately to the edge of cover disc 32. Diffusion director 22 is tangential to sidewall 28 of cup 26 and approximately parallel to diffusion director 24. Both diffussion directors 22 and 24 preferably terminate at a line L which is approximately parallel to the length of wand 18. The closed annular channel 44 contains solid getter material 42. Wand 18 is attached to the bottom of cup 26. Wire support member 34 is also attached to the bottom of receptacle 26. Ends 35 and 36 of wire support member 34 are bent to form two spaced apart curved bases 38 and 40 for contacting the resistive coating 33 on the funnel portion 15 of the tube 11.

Figure 4:
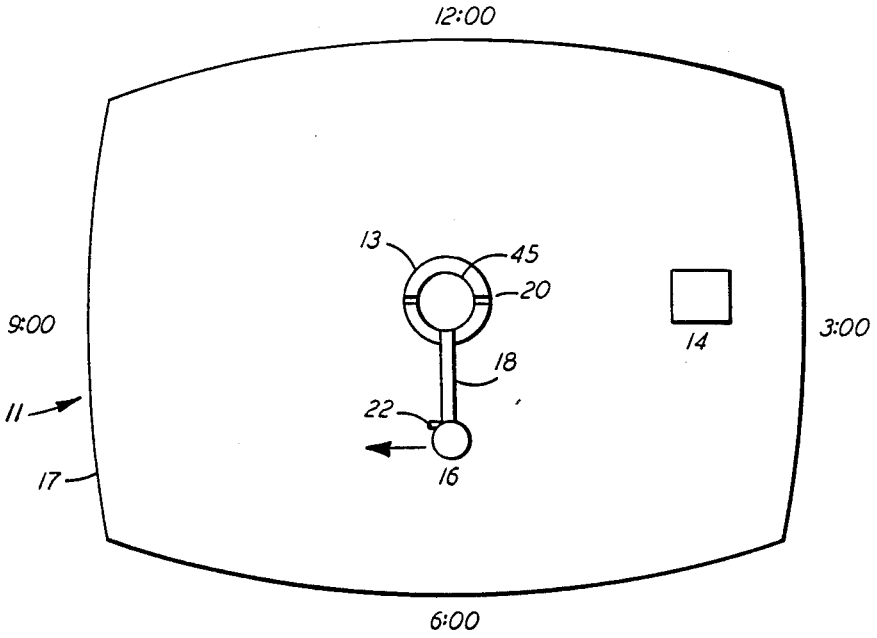
FIG. 4 is a front view of the funnel and neck portions of the cathode ray tube of FIG. 1.

When the getter assembly is assembled into the funnel area 15 of a cathode ray tube 11, as viewed along the rotational or Z axis of the tube, it is located about 90° from any required clear window area 14, with diffusion directors 22 and 24 oriented to direct diffusion of gettering material about 180° from the clear area 14. For example, FIG. 4 shows a frontal view of tube 11, with the face panel removed, in which the top, bottom and sides of the viewing area are conventionally designated at 12:00, 6:00, 3:00 and 9:00, corresponding to positions on the face of an analog clock. In the example shown, the getter is oriented in the 6:00 position with its diffusion directors positioned to direct getter material to the 9:00 position, leaving the window 14 at the 3:00 position relatively free of getter material.

When the getter is "flashed", by its design and orientation in funnel 15, there is also minimal deposition of gettering material in both the mask area and neck area.

While there have been shown and described what are at present considered to be the preferred embodiments of the invention, it will be apparent to those skilled in the art that various changes and modifications may be made therein without departing from the scope of the invention as defined in the appended claims.

I claim:

1. In a cathode ray tube having an envelope formed of a sealed integration of neck, funnel and panel portions providing an enclosure for structural components including a multielectrode electron gun assembly located in said neck portion in a manner to project at least one electron beam to traverse a multiapertured member and impinge upon a cathodoluminescent screen disposed on the interior surface of said panel, the funnel portion containing external and internal electrically resistive coatings interrupted in at least one area to define a clear window in the funnel wall; and a getter assembly comprising a getter container and a wand connecting the container to the electron gun assembly;

an improved getter container comprising a cylindrically shaped metal receptacle containing a sidewall member and a bottom portion, a support member attached to the bottom of said receptacle, and effusion directing means consisting of: (a) an overlapping cover disc attached to top of said receptacle; and (b) first and second tabs extending outwardly from an opening in said sidewall, the getter container located on the wand in a manner that the diffusion directors are in a plane approximately normal to said wand, and as viewed along the Z axis of the tube, is located approximately 90 degrees from the clear window area with the diffusion directors oriented to direct the diffusion of gettering material approximately 180 degrees away from said clear window area.

2. The improved getter container according to claim 1 wherein the first tab is located in a plane approximately on the center line of said receptacle and extends to approximately the edge of said cover disc, and the second tab is located in a plane approximately tangential to said receptacle sidewall and approximately parallel to said first tab.

3. The improved getter container according to claim 2 wherein the intersecting lines between the cylindrical sidewall and the tabs are separated on the sidewall by an angle of about 90°.

4. The improved getter container of claim 3 wherein the second tab is approximately 3 times the length of said first tab.

5. The improved getter container according to claim 1 wherein the bottom portion of the receptacle has an upraised portion, and the height of the sidewall member is about two times greater than the height of the upraised portion.

* * * * *